US010386125B2

(12) United States Patent
Perus et al.

(10) Patent No.: US 10,386,125 B2
(45) Date of Patent: Aug. 20, 2019

(54) HEAT EXCHANGER HAVING FITTING ASSEMBLY

(71) Applicant: DANA CANADA CORPORATION, Oakville (CA)

(72) Inventors: Mathias Perus, Saint-Quentin (FR); Rachid Belhabtti, Chauny (FR)

(73) Assignee: Dana Canada Corporation, Oakville, ON (CA)

( * ) Notice: Subject to any disclaimer, the term of this patent is extended or adjusted under 35 U.S.C. 154(b) by 729 days.

(21) Appl. No.: 13/261,955

(22) PCT Filed: Mar. 18, 2013

(86) PCT No.: PCT/CA2013/050221

§ 371 (c)(1),
(2) Date: Sep. 18, 2014

(87) PCT Pub. No.: WO2013/138931

PCT Pub. Date: Sep. 26, 2013

(65) Prior Publication Data

US 2015/0021904 A1 Jan. 22, 2015

(30) Foreign Application Priority Data

Mar. 19, 2012 (FR) ..... 12 52447

(51) Int. Cl.
*F28F 3/00* (2006.01)
*F28F 3/08* (2006.01)
(Continued)

(52) U.S. Cl.
CPC ..... *F28F 3/08* (2013.01); *B21D 53/04* (2013.01); *F28D 9/0043* (2013.01); *F28F 9/0246* (2013.01); *Y10T 29/49366* (2015.01)

(58) Field of Classification Search
CPC ..... F28F 9/0278; F28F 9/0248; F28F 3/08; B21D 53/04
(Continued)

(56) References Cited

U.S. PATENT DOCUMENTS 4,887,849 A * 12/1989 Briet ..... F16L 37/098 285/91
5,062,478 A * 11/1991 Potier ..... F16L 37/098 165/178
(Continued)

FOREIGN PATENT DOCUMENTS

CA 2505621 A1 10/2006
CN 1680742 A 10/2005
(Continued)

OTHER PUBLICATIONS

Translation of JP 08159688 A entitled Translation—JP 08159688 A.*

*Primary Examiner* — Paul Alvare
(74) *Attorney, Agent, or Firm* — Marshall & Melhorn, LLC

(57) ABSTRACT

A fitting assembly containing a fitting, a first plate and a second plate are provided. The first plate has a first plate wall and a first-plate aperture, the first-plate wall being positioned along an edge of the first plate defining the first-plate aperture. The second plate has a second-plate wall and a second-plate aperture, the second-plate wall being positioned along an edge of the second plate defining the second-plate aperture. The fitting assembly having the fitting being sandwiched between the first plate wall and the second plate wall. Also disclosed is a heat exchanger having the fitting assembly as described herein, and a method of forming the fitting assembly.

9 Claims, 7 Drawing Sheets

(51) Int. Cl.

| | |
|---|---|
| ***F28F 9/04*** | (2006.01) |
| ***F16L 5/00*** | (2006.01) |
| ***F16L 27/00*** | (2006.01) |
| ***F16L 41/00*** | (2006.01) |
| ***F28F 9/02*** | (2006.01) |
| ***F28D 9/00*** | (2006.01) |
| ***B21D 53/04*** | (2006.01) |

(58) Field of Classification Search
USPC ..... 165/167, 178; 285/189
See application file for complete search history.

(56) References Cited

U.S. PATENT DOCUMENTS

| | | | | | |
|---|---|---|---|---|---|
| 5,165,468 | A * | 11/1992 | Tajima | B60K 11/04 | 165/167 |
| 5,511,612 | A * | 4/1996 | Tajima | F28D 9/0012 | 165/167 |
| 5,551,506 | A | 9/1996 | Nishishita | | |
| 5,699,852 | A * | 12/1997 | Park | F28F 19/02 | 165/133 |
| 5,918,667 | A * | 7/1999 | Chiba | F28F 9/182 | 165/173 |
| 6,196,306 | B1 * | 3/2001 | Aikawa | F28D 1/0333 | 165/153 |
| 7,188,664 | B2 * | 3/2007 | Fuller | F28D 9/0043 | 165/140 |
| 2005/0150647 | A1 * | 7/2005 | Calhoun | F28F 9/0234 | 165/178 |
| 2006/0244255 | A1 | 11/2006 | Coscarella | | |

FOREIGN PATENT DOCUMENTS

| | | | | |
|---|---|---|---|---|
| EP | 347961 | A1 | 12/1989 | |
| EP | 660053 | A1 | 6/1995 | |
| EP | 0660053 | A1 | 6/1995 | |
| FR | 2735842 | A1 | 12/1996 | |
| FR | 2962206 | A1 | 1/2012 | |
| JP | 08159688 | A * | 6/1996 | F28F 9/0246 |

* cited by examiner

HEAT EXCHANGER HAVING FITTING ASSEMBLY

FIELD

The specification relates to a brazed fitting assembly.

BACKGROUND

A stacked plate-type heat exchanger is made up of plurality of heat exchanger plates that are stacked one on top of each other. The plurality of plates define a conduit for flow of a first fluid, which in one embodiment is, for example and without limitation, a engine oil when the heat exchanger is, for example, an engine oil cooler (EOC). Each of the plurality of plates has at least a pair of openings that are aligned in the plurality of plates, and which form part of the inlet and outlet manifolds of the heat exchanger. The inlet and outlet manifolds have an inlet and outlet, respectively, and permit flow of the first fluid from the inlet to pass through the conduits (provided by the plurality of plates) and exit from the outlet. Different types of stacked plate-type heat exchangers are known in the art.

Typically, the inlet and outlet receive a fitting to which a hose or other tubing can be attached. One method of attaching a fitting to the heat exchanger is shown in FIG. 1, which shows a cross-sectional view of a fitting, having a flange, which is brazed to the reinforcement plate. One of the challenges with such a fitting assembly is associated with proper alignment of the fitting with the apertures of the reinforcement and cover plates. Sliding or shifting of the fitting can occur and can result in an improperly aligned fitting. In addition, clad material needs to be present on both sides of the reinforcement plate for brazing to form the fitting assembly.

To address some of the disadvantages associated with the fitting assembly shown in FIG. 1, alternative fitting assemblies can be used, as shown in FIGS. 2 and 3.

In the fitting assembly shown in FIG. 2, the fitting is provided with a flange, similar to that shown in FIG. 1. However, the flange is not present at the end of the fitting, but rather is positioned, such that the flange rests on the reinforcement plate of the heat exchanger and a portion of the fitting extends below the reinforcement plate and the cover plate of the heat exchanger. This portion of the fitting that extends below the cover plate undergoes a swaging operation to form a lip to clamp the reinforcement plate and the cover plate between the flange and the lip, to affix the fitting to the heat exchanger and form the fitting assembly.

FIG. 3 shows another example of the fitting assembly that can be used for affixing the fitting to the heat exchanger. The difference between the fitting assembly in FIG. 2 and FIG. 3 is that the fitting shown in FIG. 3 has a preformed large bead. A tool is inserted from the bottom of the fitting to expand the fitting wall outwards to secure it to the reinforcement plate and cover plate. This process of expanding from the inside is called "staking". A swaging operation can also be performed on the lower portion of the fitting to form the lip (similar to the fitting shown in FIG. 2) to affix the fitting to the reinforcement and cover plates.

In the fitting assemblies described above, clad material is provided between the reinforcement plate and the cover plate of the heat exchanger. In addition, clad material is also provided on the top surface of the reinforcement plate, and is therefore, present on both sides of the reinforcement plate. During brazing operation, the clad material, which functions as a filler material, helps to bond the reinforcement plate to the cover plate, for bonding the fitting to the heat exchanger and for filling any voids. As clad material can be expensive, there is a need in the art to reduce the use of such material. Therefore, there is also a need in the art for a heat exchanger assembly where the clad material is present on one side of the reinforcement plate, rather than on both sides.

Further to the above, one of the challenges that can be associated with the fitting assemblies described above is the proper alignment of the fitting with the heat exchanger. In addition, during coupling of the fitting to the heat exchanger, care should be taken to ensure that the fitting is properly positioned with the heat exchanger, such that it does not result in unnecessary angular movement of the fitting. Therefore, there is a need in the art for a fitting assembly that can help to ensure proper positioning of the fitting, or more preferably the fitting is a self-positioning fitting. Moreover, there is a need in the art for a fitting assembly that can help with avoiding the unnecessary angular movement of the fitting during the coupling procedure.

SUMMARY OF THE INVENTION

In one aspect, the specification discloses to a fitting assembly, containing:

a fitting;

a first plate having a first plate wall and a first-plate aperture, the first-plate wall being positioned along an edge of the first plate defining the first-plate aperture; and a second plate having a second-plate wall and a second-plate aperture, the second-plate wall being positioned along an edge of the second plate defining the second-plate aperture;

the fitting assembly having the fitting being sandwiched between the first plate wall and the second plate wall.

In a second aspect, the specification discloses to a heat exchanger assembly, containing:

a plurality of heat exchanger plates defining a conduit for flow of a first fluid;

inlet and outlet manifolds coupled to the heat exchanger plates permitting flow of the first fluid, the inlet manifold having an inlet and the outlet manifold having an outlet that are in fluid communication with the conduit;

a first plate having a first plate wall and a first-plate aperture, the first-plate wall being positioned along an edge of the first plate defining the first-plate aperture; and a second plate having a second-plate wall and a second-plate aperture, the second plate being coupled to the inlet or outlet manifold, and the second-plate wall being positioned along an edge of the second plate defining the second-plate aperture; and a fitting, the fitting being sandwiched between the first plate wall and the second plate wall, and in fluid communication with the inlet or outlet.

In a third aspect, the specification discloses a process for forming a fitting assembly, the fitting assembly containing a fitting; a first plate having a first plate wall and a first-plate aperture, the first-plate wall being positioned along an edge of the first plate defining the first-plate aperture; a second plate having a second-plate wall and a second-plate aperture, the second-plate wall being positioned along an edge of the second plate defining the second-plate aperture; and the fitting assembly having the fitting being sandwiched between the first plate wall and the second plate wall; the process containing the steps of:

coupling the first plate with the second plate;

inserting the fitting in the first-plate aperture; and swagging the second-plate for sandwiching the fitting between the first plate wall and the second plate wall.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION

The specification relates to a fitting assembly, and has been described herein with reference to a stacked plate-type heat exchanger assembly (2) as an embodiment, without being particularly limited to it.

As noted above, in one aspect the specification discloses a fitting assembly, containing:

a fitting;

a first plate having a first plate wall and a first-plate aperture, the first-plate wall being positioned along an edge of the first plate defining the first-plate aperture; and a second plate having a second-plate wall and a second-plate aperture, the second-plate wall being positioned along an edge of the second plate defining the second-plate aperture;

the fitting assembly having the fitting being sandwiched between the first plate wall and the second plate wall.

In a second aspect, the specification discloses a heat exchanger assembly, containing:

a plurality of heat exchanger plates defining a conduit for flow of a first fluid;

inlet and outlet manifolds coupled to the heat exchanger plates permitting flow of the first fluid, the inlet manifold having an inlet and the outlet manifold having an outlet that are in fluid communication with the conduit;

a first plate having a first plate wall and a first-plate aperture, the first-plate wall being positioned along an edge of the first plate defining the first-plate aperture; and a second plate having a second-plate wall and a second-plate aperture, the second plate being coupled to the inlet or outlet manifold, and the second-plate wall being positioned along an edge of the second plate defining the second-plate aperture; and a fitting, the fitting being sandwiched between the first plate wall and the second plate wall, and in fluid communication with the inlet or outlet.

Figure 1:
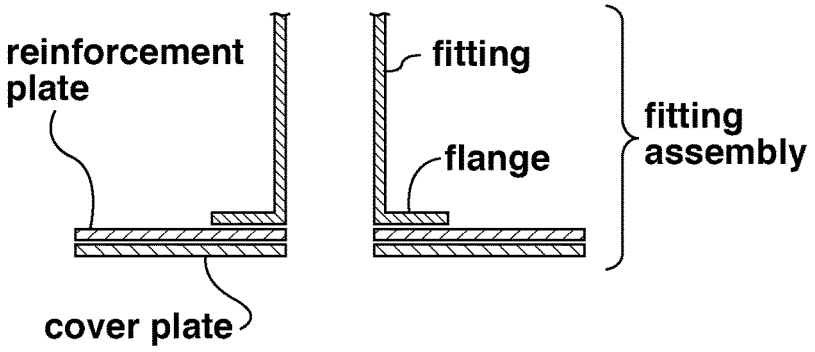
FIG. 1 shows one example of a cross-sectional area of a fitting assembly.
Figure 2:
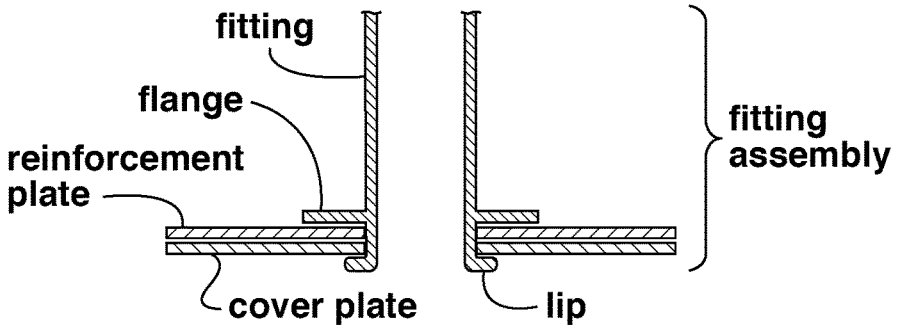
FIG. 2 shows a second example of a cross-sectional area of a fitting assembly.
Figure 3:
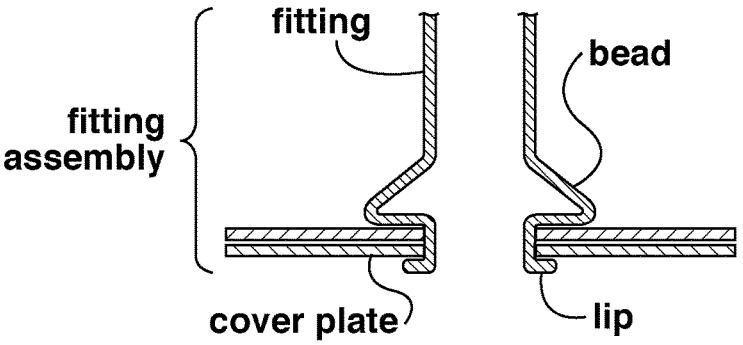
FIG. 3 shows a third example of a cross-sectional area of a fitting assembly.
Figure 4:
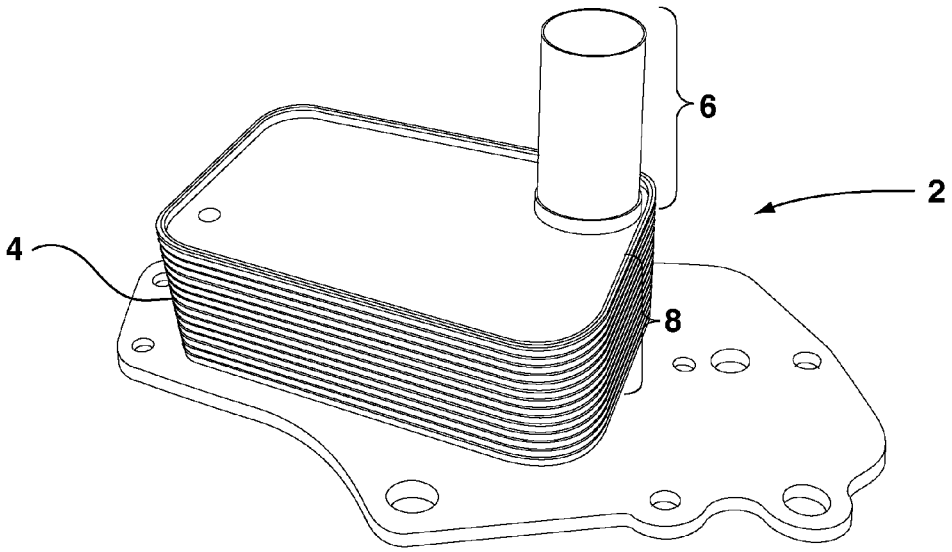
FIG. 4 shows a picture of one embodiment of a heat exchanger assembly in accordance with an embodiment of the specification.
Figure 5:
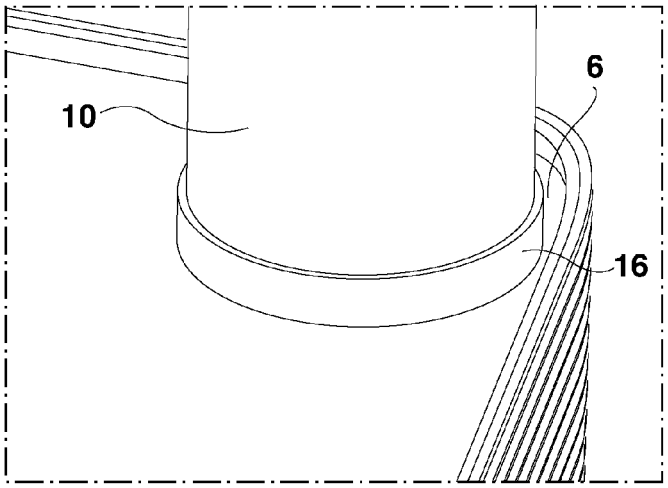
FIG. 5 shows a picture of an expanded area of the heat exchanger shown in FIG. 4.

FIG. 4 discloses an embodiment of a stacked plate-type heat exchanger assembly (2) having a heat exchanger (4) and a fitting assembly (6). The heat exchanger (4) is made up of a plurality of plates (8) that are stacked one on top of each other and provide a conduit (46) for flow of a first fluid. Each of the plurality of plates (8) has at least two apertures that are in fluid communication with the conduit, with one of the apertures forming part of the inlet or outlet manifold (44) of the heat exchanger (4). As shown in FIGS. 4 and 5, the heat exchanger (4) is provided with a fitting assembly (6) that is also in fluid communication with either the inlet or outlet (42) of the inlet or outlet manifolds (44), respectively.

Figure 6:
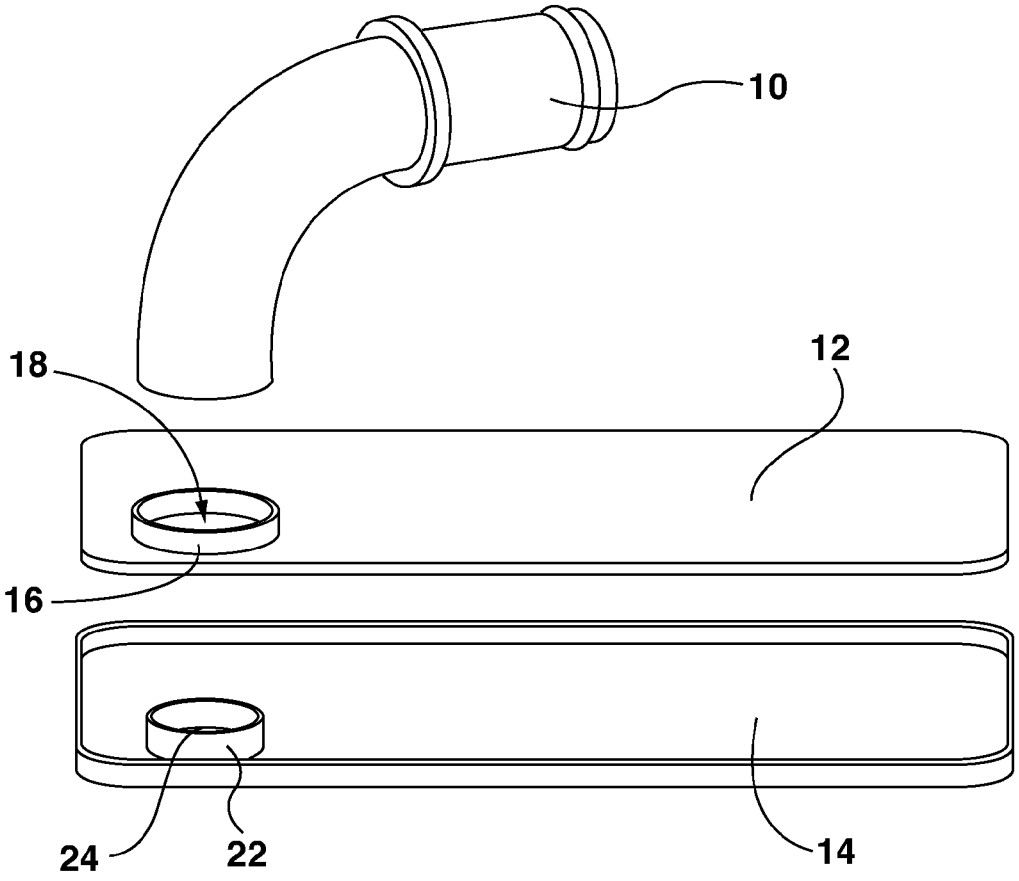
FIG. 6 shows an exploded view of the fitting assembly in accordance with an embodiment of the specification.
Figure 7:
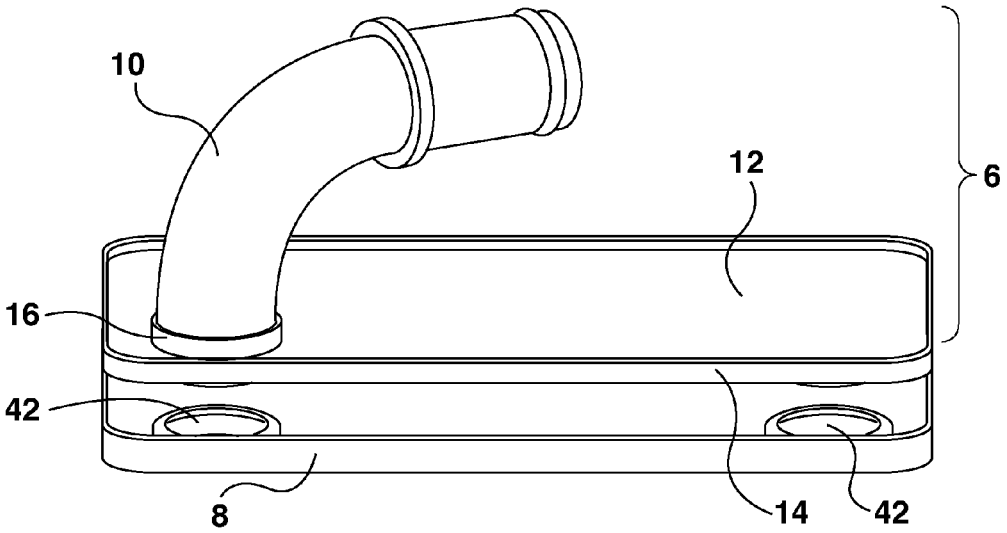
FIG. 7 shows an assembled embodiment of the fitting assembly of FIG. 6.

The fitting assembly (6) as shown in FIGS. 6 and 7 contains a fitting (10), a first plate (12) and a second plate (14). The type of fitting (10) used is not particularly limited and can depend on the application and requirements of the individual assembly. In one embodiment, for example and without limitation, the fitting (10) is a tubular fitting having a channel, as shown in the figures. However, in other embodiments, the fitting can have other shapes, such that the cross-section of the fitting is triangular, square or hexagon.

The first plate (12) as disclosed herein is not particularly limited. In one embodiment, for example and without limitation, the first plate (12) is a reinforcement plate of a heat exchanger assembly (2). The first plate (12) has a first-plate wall (16) and a first-plate aperture (18), with the first-plate wall (16) positioned along an edge of the first plate (20) that defines the first-plate aperture (18).

Figure 14:
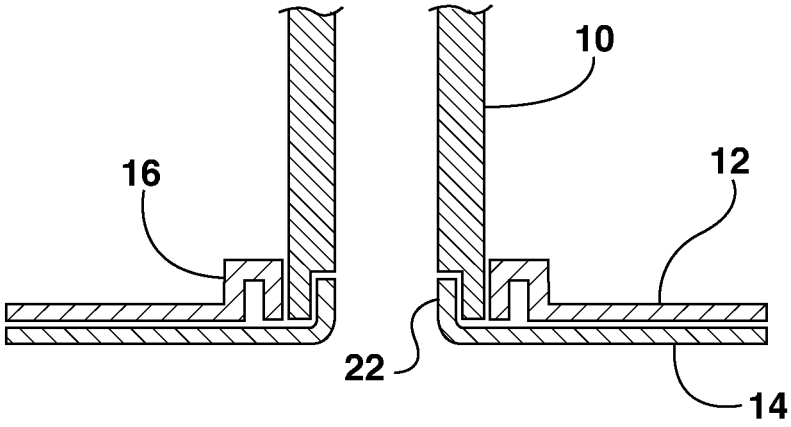
FIG. 14 shows a cross-sectional view of a third embodiment of the fitting assembly in accordance with the specification.

The first-plate wall (16) present in the fitting assembly (6), as described herein, is not particularly limited. In one embodiment, for example and without limitation, the first-plate wall (16) is cylindrical as shown in FIGS. 6 and 7. However, the first-plate wall (16) can be provided as a plurality of wall sections extending from the first plate (12) along the edge of the first-plate (20) to provide support for the fitting (10). The number of wall sections is not particularly limited and can be varied depending upon the particular embodiment and needs of the fitting assembly (6), so long as it can provide support for the fitting (10). In another embodiment, an inverted U-shaped wall (FIG. 14) can be provided.

The second plate (14) as disclosed herein is not particularly limited. In one embodiment, for example and without limitation, the second plate (14) is a cover plate of a heat exchanger (4). The second plate (14), similar to the first plate (12), has a second-plate wall (22) and a second-plate aperture (24), with the second-plate wall (22) positioned along an edge of the second plate (26) that defines the second-plate aperture (24). The second-plate wall (22), similar to the first-plate wall (16), in one embodiment for example and without limitation, is cylindrical as shown in the figures, while in other embodiments, it can be provided as a plurality of wall sections, so long as it can provide support for the fitting (10) and to affix the fitting between the first-plate wall (16) and the second-plate wall (22).

Figure 8:
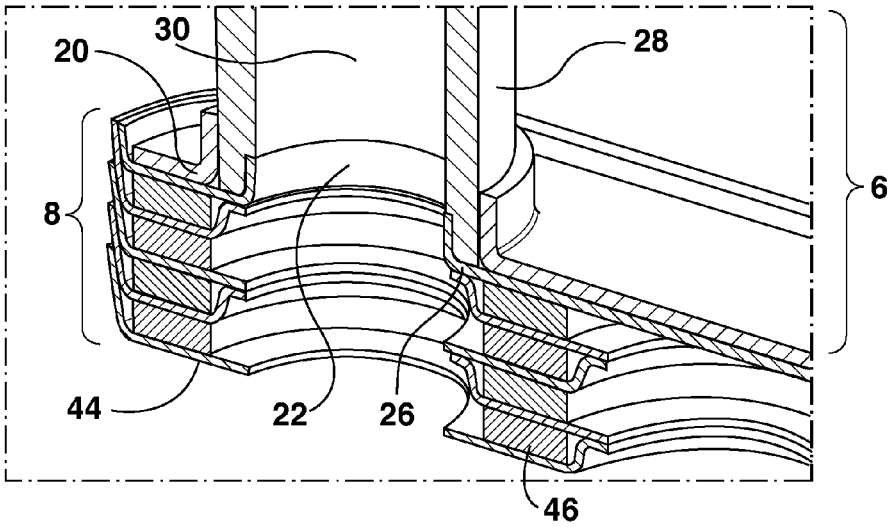
FIG. 8 shows a cross-sectional view of a portion of the heat exchanger assembly in accordance with an embodiment of the specification.
Figure 9:
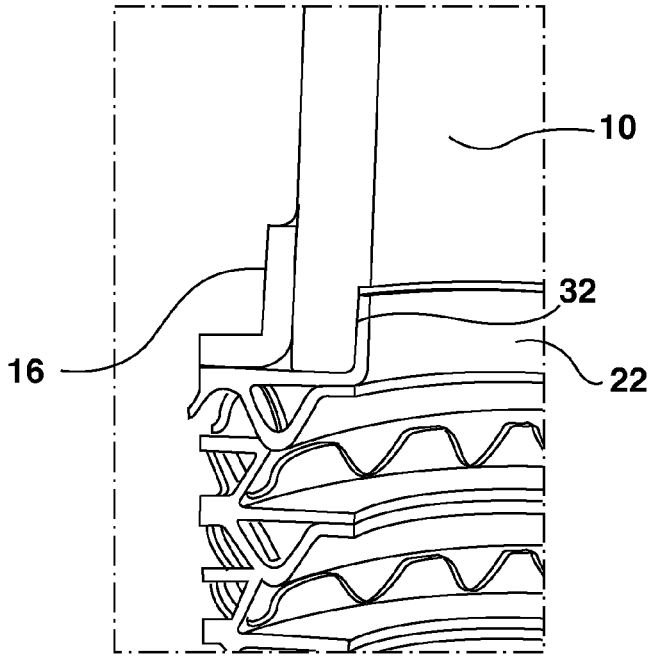
FIG. 9 shows a picture of a cross-section of a heat exchanger assembly in accordance with an embodiment of the specification.
Figure 10:
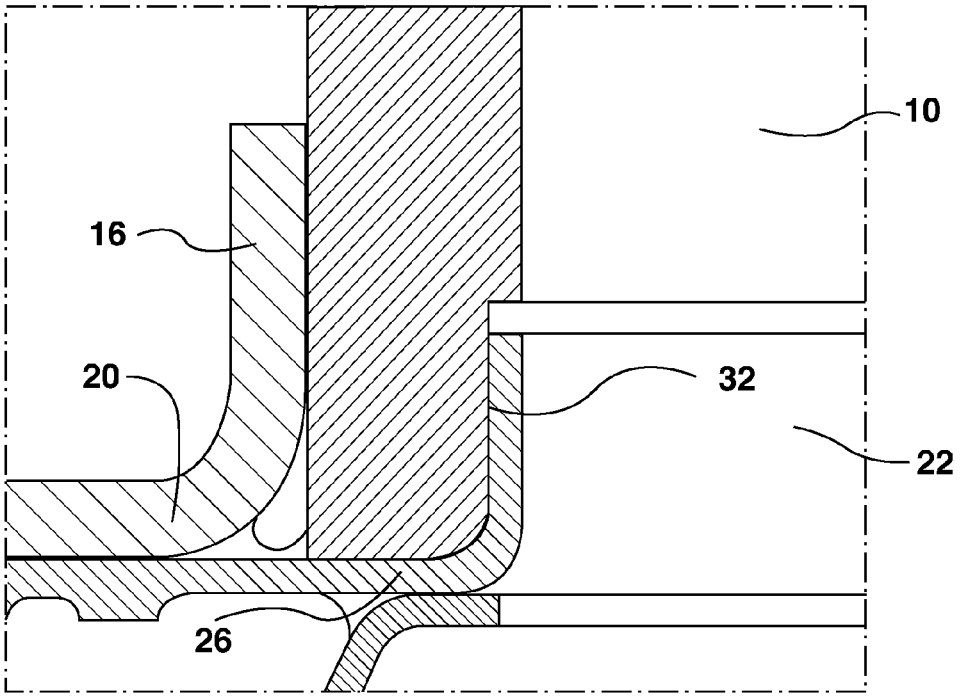
FIG. 10 shows a second picture of a cross-section of a heat exchanger assembly in accordance with an embodiment of the specification.
Figure 11:
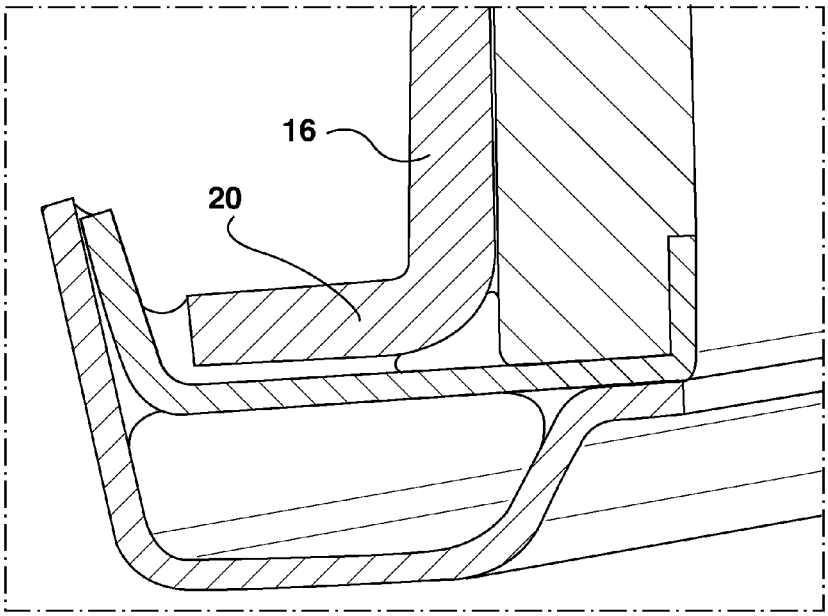
FIG. 11 shows a third picture of a cross-section of a heat exchanger assembly in accordance with an embodiment of the specification.
Figure 12:
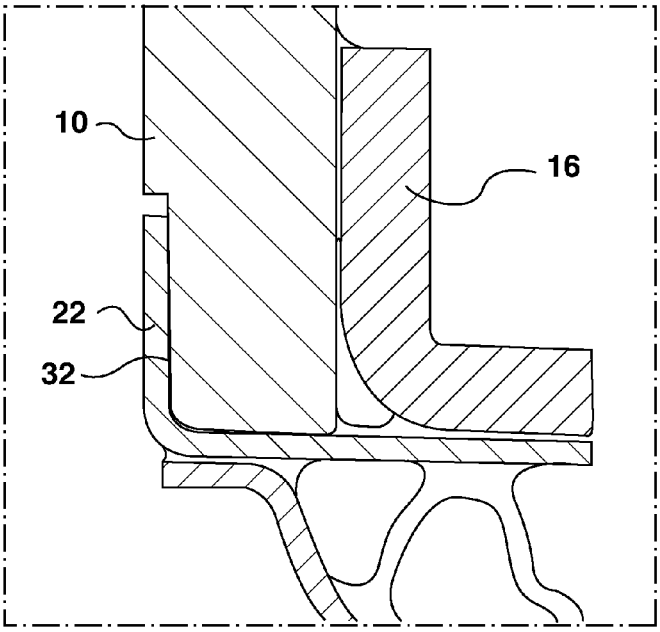
FIG. 12 shows a fourth picture of a cross-section of a heat exchanger assembly in accordance with an embodiment of the specification.

The first and second-plate walls (16, 22) extending from the first and second-plates (12, 14) can be, in one embodiment, for example and without limitation, perpendicular to the surface of the first and second-plates (12, 14) (FIGS. 5, 6 and 8). Alternatively, in another embodiment, the first and second-plate walls (16, 22) extending from the first and second-plates (12, 14) are at an angle from the surface of the first and second-plates (12, 14) (FIGS. 10 and 11). The angle between the first-plate wall (16) and the first plate (12), or between the second-plate wall (22) and the second plate (14) is not particularly limited, so long as it can provide support and affix the fitting (10).

In one embodiment, as shown in the figures, the first and second-plate walls (16, 22) extend in the same direction from the first and second-plates (12, 14). In another embodiment, for example and without limitation, the first plate wall (16) is an inverted U-shaped member (FIG. 14) such that the first-plate wall (16) extending from the first plate (12) projects in the opposite direction from the second-plate wall (22). In such an embodiment as well, the fitting (10) is still affixed between the first and second-plate walls (16, 22) due to the diameters of the first and second-plate apertures (18, 24).

In the fitting assembly (6), as shown in FIG. 8, the diameter of the first-plate aperture (18) is larger than the diameter of the second-plate aperture (24). The diameters of the first-plate and second-plate apertures (18, 24) are selected to ensure that the first-plate wall (16) contacts the outer surface of the fitting (28) and the second-plate wall (22) contacts the inner surface of the fitting (30)

Figure 13:
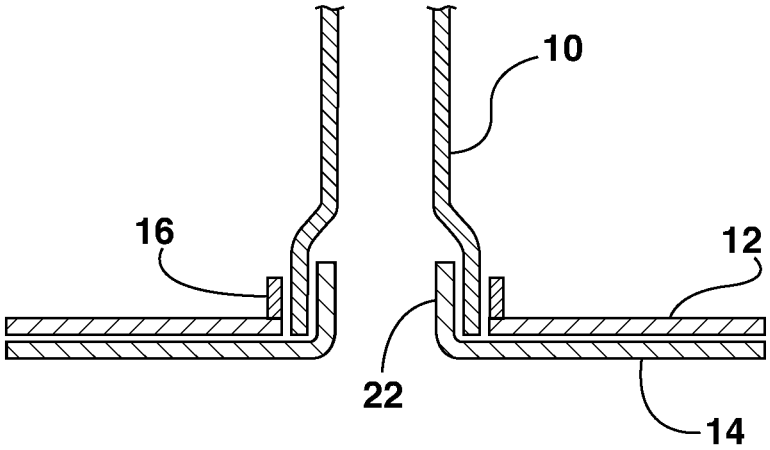
FIG. 13 shows a cross-sectional view of a second embodiment of the fitting assembly in accordance with the specification.

In a further embodiment, as shown in FIGS. 9-12, the fitting (10) is provided with a cut-out (32) such that the second-plate wall (22) complements the cut-out (32), when the fitting (10) is affixed between the first and second-plate walls (16, 22). Such an embodiment can also avoid impeding or minimize the impact on the flow of the fluid flowing through the fitting (10) and into the inlet or outlet (42) of the inlet or outlet manifold (44), respectively. In another embodiment, the wall of the fitting (10) near the first and second plates (12, 14) can be expanded (FIG. 13) to provide a larger inner diameter than the remaining inner diameter of the fitting (10). This can allow the use of a fitting (10) without a cut-out (32) and also use of a fitting (10) having a reduced wall thickness.

In a third aspect, the specification relates to a process for forming a fitting assembly, the fitting assembly containing a fitting; a first plate having a first plate wall and a first-plate aperture, the first-plate wall being positioned along an edge of the first plate defining the first-plate aperture; a second plate having a second-plate wall and a second-plate aperture, the second-plate wall being positioned along an edge of the second plate defining the second-plate aperture; and the fitting assembly having the fitting being sandwiched between the first plate wall and the second plate wall; the process containing the steps of:

coupling the first plate with the second plate;

inserting the fitting in the first-plate aperture; and swagging the second-plate for sandwiching the fitting between the first plate wall and the second plate wall.

The process of coupling the first plate (12) with the second plate (14) is not particularly limited. The coupling can simply be provided by placing the first-plate (12) in contact with the second-plate (14). In one embodiment, for example and without limitation, the first plate (12) and second plate (14) are clad together. In another embodiment, for example and without limitation, the first plate (12) and second plate (14) are brazed together. Further, cladding and brazing can be carried out to couple the first plate (12) to the second plate (14). In the embodiment disclosed herein, the clad material can only be provided on one surface of the first plate (12), which faces the second plate (14).

The fitting (10) is then inserted into the first-plate aperture (18); and the walls of the first-plate (16) can assist with alignment of the fitting (10) in the fitting assembly (6). Although the process has been described with the coupling between the first plate (12) and the second plate (14) taking place before insertion of the fitting (10) in the first-plate aperture (18); it should be understood that the step of coupling the first plate (12) to the second plate (14) can be performed after insertion of the fitting (10) in the first-plate aperture (18).

The process then involves swaging the second-plate (14) for sandwiching the fitting (10) between the first-plate wall (16) and the second-plate wall (22). In one embodiment, for example and without limitation, the second-plate (14) has the second-plate wall (22) present prior to the swaging process, so that the swaging results in affixing the fitting (10) between the first and second-plate walls (16, 22).

In another embodiment, the second-plate (14) lacks the second-plate wall (22) and the second plate (14) is provided with a hole that has a smaller diameter than the second-plate aperture (24) present in the fitting assembly. In such an embodiment, the fitting (10) upon insertion into the first-plate aperture (18) contacts and is stopped by the second plate (14). The swaging process is then performed by insertion of the swaging tool into the hole of the second plate (14), and which results in formation of the second-plate wall (22) and expansion of the diameter of the hole in the second plate (14) to form the second-plate aperture (24). In addition, the fitting (10) is then affixed between the first and second-plate walls (16, 22).

One of the advantages of the above embodiment is that the diameter of the hole can be set such that the second-plate wall (22) formed is complementary to the cut-out on the inner surface of the fitting (30) and is received within the cut-out during the swaging process. This can help in tightly affixing the fitting (10) between the first and second-plate walls (16, 22) during the swaging process.

After affixing the fitting (10) to the first and second plates (12, 14), brazing can be performed for brazing the fitting assembly (6) together. During the brazing step, clad material can flow from between the first and second plates (12, 14) and fill in spaces between the first-plate wall (16) and the fitting (10), and/or the spaces between the second-plate wall (22) and the fitting (10), and thereby, further affixing the fitting (10) to the fitting assembly (6).

The fitting assembly (6) and the heat exchanger assembly (2) described herein can provide a self-positioning fitting (10) and can result in a fitting (10) that is more properly located. In addition, the fitting assembly (6) and the heat exchanger (2) described herein can have clad material present on only one side.

Certain adaptations and modifications of the described embodiments can be made. Therefore, the above discussed embodiments are considered to be illustrative and not restrictive.

PART NUMBERS AND THEIR BRIEF DESCRIPTION

| | | | |
|---|---|---|---|
| 2 | heat exchanger assembly | 4 | heat exchanger (HX) |
| 6 | fitting assembly | 8 | plurality of HX plates |
| 10 | fitting | 12 | first plate |
| 14 | second plate | 16 | first-plate wall |
| 18 | first-plate aperture | 20 | edge of first-plate |
| 22 | second-plate wall | 24 | second-plate aperture |
| 26 | edge of second-plate | 28 | outer surface of the fitting |
| 30 | inner surface of the fitting | 32 | cut-out |
| 34 | — | 36 | — |
| 38 | — | 40 | — |
| 42 | inlet or outlet | 44 | inlet or outlet manifold |
| 46 | conduit of HX | | |

What is claimed is:

1. A heat exchanger assembly, comprising:

a plurality of heat exchanger plates defining a conduit for flow of a first fluid;

inlet and outlet manifolds coupled to the heat exchanger plates permitting flow of the first fluid, the inlet manifold having an inlet and the outlet manifold having an outlet that are in fluid communication with the conduit;

a first plate having a first plate wall and a first-plate aperture, the first-plate wall being perpendicular to the first plate and positioned along an edge of the first plate defining the first-plate aperture; and a second plate having a second-plate wall and a second-plate aperture, the second plate being coupled to the inlet or outlet manifold, and the second-plate wall being perpendicular to the second plate and positioned along an edge of the second plate defining the second-plate aperture; the first plate wall and the second plate wall extend in the same direction from the first and second plates respectively, with the first plate contacting the second plate;

a third plate adjacent to and spaced apart from the second plate, the third plate having a boss extending from the third plate towards the second plate, the boss having a flat planar surface in contact with the second plate, the boss further defining a third plate aperture that permits fluid communication from the second-plate aperture through the third plate aperture; and a tubular fitting having a channel, the fitting being sandwiched between the first plate wall and the second plate wall, and in fluid communication with the inlet or outlet, and wherein the inner surface of the fitting has a cut-out for receiving the second plate wall.

2. The heat exchanger assembly according to claim 1, wherein an edge of the flat planar surface defining the third-plate aperture aligns with the edge of the second plate defining the second-plate aperture.

3. The heat exchanger assembly according to claim 1, wherein the boss extending from the third plate has a S-shaped cross-section.

4. The heat exchanger assembly according to claim 1, wherein a diameter of the first plate aperture is larger than a diameter of the second plate aperture.

5. The heat exchanger assembly according to claim 1, wherein the first-plate wall is cylindrical and extends along the entire edge of the first plate defining the first-plate aperture.

6. The heat exchanger assembly according to claim 1, wherein the second-plate wall is cylindrical and extends along the entire edge of the second plate defining the second-plate aperture.

7. The heat exchanger assembly according to claim 1, wherein the first and second plates are clad together.

8. The heat exchanger assembly according to claim 1, wherein the fitting is brazed to the first and second plates for affixing the fitting.

9. The heat exchanger assembly according to claim 1, wherein the heat exchanger assembly is formed by a plate-type heat exchanger.

* * * * *